US006139653A

United States Patent [19]

Fernandes et al.

[11] Patent Number: 6,139,653

[45] Date of Patent: Oct. 31, 2000

[54] ALUMINUM-MAGNESIUM-SCANDIUM ALLOYS WITH ZINC AND COPPER

[75] Inventors: Micky T. Fernandes, Newark; Ralph C. Dorward, Livermore, both of Calif.

[73] Assignee: Kaiser Aluminum & Chemical Corporation, Pleasanton, Calif.

[21] Appl. No.: 09/372,979

[22] Filed: Aug. 12, 1999

[51] Int. Cl.[7] ..... C22C 21/06

[52] U.S. Cl. ..... 148/439

[58] Field of Search ..... 148/415, 418, 148/439, 440; 420/531, 532, 533, 542, 543

[56] References Cited

U.S. PATENT DOCUMENTS

| | | | |
|---|---|---|---|
| 3,619,181 | 11/1971 | Willey . | |
| 4,927,470 | 5/1990 | Cho | 148/415 |
| 5,066,342 | 11/1991 | Rioja et al. . | |
| 5,108,519 | 4/1992 | Armanie et al. . | |
| 5,151,136 | 9/1992 | Witters et al. | 148/689 |
| 5,211,910 | 5/1993 | Pickens et al. | 420/532 |
| 5,554,428 | 9/1996 | Bartges et al. . | |
| 5,597,529 | 1/1997 | Tack . | |
| 5,601,934 | 2/1997 | Bartges et al. . | |
| 5,620,652 | 4/1997 | Tack et al. . | |
| 5,624,632 | 4/1997 | Baumann et al. . | |

OTHER PUBLICATIONS

Kolerov et al., "Distinctive Features of Primary Crystallization in Alloy 1570", Metal Science and Heat Treatment, vol. 36, No. 12, pp. 649–654 (1994).

Elagin et al., "Nonferrous Metals and Alloys", Metal Science and Heat Treatment, vol. 36, No. 7, pp. 375–380 (1994).

Roder et al., "Correlation Between Microstructure and Mechanical Properties of Al–Mg Alloys Without and With Scandium", Materials Science Forum vols. 217–222, pp. 1835–1840, (1996).

Roder et al., "Fatigue Properties of Al–Mg Alloys With and Without Scandium", Materials Science and Engineering, A234–236, 181–184, (1997).

Haszler et al., "Hoogovens and the High Speed Ferry", Aluminum Today, pp. 26–27, (Jan./Feb. 1998).

*Primary Examiner*—Sikyin Ip

*Attorney, Agent, or Firm*—Jones, Tullar & Cooper PC

[57] ABSTRACT

Al—Mg—Sc based alloys include additional elements selected from the group comprising Hf, Mn, Zr, Cu and Zn to improve their tensile properties. The alloys are preferably comprised of aluminum and, in wt. %, 1.0–8.0% Mg, 0.05–0.6% Sc, 0.05–0.20% Hf and/or 0.05–0.20% Zr, and 0.5–2.0% Cu and/or 0.5–2.0% Zn. In addition, 0.1–0.8 wt. % Mn may be added to the alloy to improve its strength characteristics further.

48 Claims, No Drawings

ALUMINUM-MAGNESIUM-SCANDIUM ALLOYS WITH ZINC AND COPPER

BACKGROUND OF THE INVENTION

The present invention relates to Al—Mg—Sc alloy compositions for use in aerospace applications, and the like, in which zinc, copper and other elements are added to the alloys to improve their tensile properties.

Aluminum alloys containing magnesium as the principal alloying element have two potential advantages for aircraft structures: they are lighter than the standard 2000 and 7000 series alloys; and unlike the latter materials, they are weldable by conventional fusion techniques, which could lower manufacturing costs by reducing the 2–3 million rivets typically used to assemble a commercial airliner.

A number of aluminum alloys have been developed in which magnesium is added to aluminum to improve strength. However, these alloys are not particularly suited for aerospace applications because their strength levels are not high enough. To address this problem, improved Al—Mg based alloys have been developed in which a dispersoid generating element, such as scandium, is added to the alloy. The addition of scandium to the alloys results in the formation of $Al_3Sc$ dispersoids, which are intended to prevent recrystallization during thermomechanical processing, thereby imparting significantly greater strength to products made from the alloys. However, the tensile properties of Al—Mg—Sc based alloys deteriorate rapidly with thermomechanical processing and high temperature operations, such as hot rolling, that are necessary to manufacture aircraft fuselage sheet and other components. The degradation in tensile properties occurs because the scandium dispersoids must be small in size and large in number to impart increased strength to the alloy; presumably high temperature manufacturing operations cause them to grow too large to be effective recrystallization inhibitors.

One known solution to this problem is to add zirconium to the Al—Mg—Sc alloys. Zirconium acts to stabilize the dispersoids so that they can maintain their strength enhancing characteristics, even after the alloys have been subjected to high temperature operations. Although Al—Mg—Sc—Zr based alloys are thus somewhat suitable for aerospace applications, a need still remains for aluminum alloys that are even stronger than presently available alloys.

SUMMARY OF THE INVENTION

The present invention fulfills the foregoing need through provision of Al—Mg—Sc based alloys in which, in addition to a dispersoid stabilizing element, specifically zirconium or hafnium, one or more additional elements are added to the alloys to enhance their tensile properties further. In particular, the addition of various combinations of manganese, copper and zinc to the alloys have been found to enhance their tensile properties substantially as compared to alloys containing only a single dispersoid stabilizing element. In addition, it has been discovered that a different dispersoid generating element, hafnium, can be employed to stabilize the dispersoids generated by the scandium. More specifically, the present invention comprises alloys, and products made therefrom, whose wt. % composition comprises 1.0–8.0% Mg, 0.05–0.6% Sc, 0.6–1.5% Cu and/or 0.6–1.5% Zn, and 0.05–0.20% Hf and/or 0.05–0.20% Zr, with the balance aluminum and incidental impurities. In addition, 0.1–0.8 wt. % Mn may also be added to the alloy. In experiments on sample alloys formed in accordance with these criteria, and subjected to rolling and heat treatment operations, substantial improvements in tensile properties, including ultimate tensile strength, yield strength and elongation, were observed as compared to an Al—Mg—Sc alloy containing only zirconium as a dispersoid stabilizing element.

DETAILED DESCRIPTION OF THE PREFERRED EMBODIMENTS

All of the embodiments of the present invention comprise Al—Mg—Sc based alloys, and products made therefrom, in which additional elements are added to the alloys to increase strength. It has been discovered previously that addition of zirconium and to an Al—Mg—Sc based alloy acts to stabilize the $Al_3Sc$ dispersoids during thermomechanical operations, such as hot rolling. As a result, the tensile properties of the alloy after processing are substantially improved. Addition of manganese to the Al—Mg—Sc—Zr alloy has been found to increase its strength even further.

The inventors of the present invention have now discovered that Al—Mg—Sc—Zr based alloys can be strengthened even further through addition of zinc and/or copper to the alloys. In addition, it has been discovered that hafnium can be substituted for or added to the zirconium in these alloys. In the preferred embodiments of the invention, the alloys include in wt. % composition, 1.0–8.0% Mg, 0.05–0.6% Sc, 0.6–1.5% Cu and/or 0.6–1.5% Zn, and 0.05–0.20% Hf and/or 0.05–0.20% Zr, with the balance aluminum and incidental impurities. The most preferred ranges of the recited elements are 4.0–6.0% Mg, 0.2–0.4% Sc, 0.08–0.15% Hf or Zr, 0.6–1.5% Cu and/or Zn, and the balance aluminum and incidental impurities. Within these ranges, alloy compositions of 5.0% Mg, 0.25% Sc, 0.12% Hf and/or 0.12% Zr, 1.0% Cu and/or 1.0% Zn, and the balance aluminum and incidental impurities, are believed to provide the best results. In addition, the alloys can also be formed with 0.1–0.8 wt. % Mn, with the most preferred range being 0.3–0.7% Mn, and 0.6% Mn believed to be optimum.

The significance of each element in the subject alloys is as follows. Mg added to the alloys in the recited amount increases strength and lowers density substantially. However, if Mg is added in amounts above approximately 8%, the resulting alloys become difficult to process. Sc and Zr are added in combination to generate stable $Al_3Sc(Zr)$ dispersoids, which as stated previously, substantially increase the strength of the alloys.

Hf, like Sc, is another dispersoid generating element that can be used in place of Sc to achieve improvements in strength. However, it has also been discovered that when Hf is used in combination with Sc, the Hf acts like Zr to stabilize the $Al_3Sc$ dispersoids during hot rolling and thermal processing. Thus, Hf can be used either in place of or with Zr. Manganese is also believed to enhance the dispersoid stabilizing effect of Zr and Sc. The amounts of Zr, Hf and Mn added to the alloys must not, however, be above the recited ranges to avoid primary formations in the alloys that would once again, diminish their tensile and other properties.

As will be demonstrated by the following examples, copper and/or zinc, when added in the specified amounts, have been found to increase the strength properties of the alloys substantially as compared to Al—Mg—Sc alloys containing either zirconium or zirconium and manganese.

EXAMPLES 1–3

To test the tensile properties of alloys formed in accordance with the present invention, a number of rolled sheet samples were prepared, and subjected to testing. First, a 3"×9" ingot was cast of each alloy. The ingots were then subjected, without homogenization, to conventional hot and cold rolling techniques until they were formed into sheets of 0.063" or 0.125" thickness. The sheets were then annealed at 550° F. for 8 hours. Conventional testing was then conducted on each sheet to determine the ultimate tensile strength (UTS), yield strength (YS), and elongation (EL).

The samples included two of known alloys, Al—Mg—Sc—Zr and Al—Mg—Sc—Zr—Mn, and three different alloys meeting the criteria of the subject invention. The results of the tests, and the compositions of each of the tested alloys are set forth in Table 1.

TABLE 1

TENSILE PROPERTIES OF Al—Mg—Sc ALLOYS
(No Homogenization, 0.063", 550 F/8 hr anneal)

| Alloy | Al—Mg—Sc—Zr | Al—Mg—Sc—Zr—Mn | 5X-1 | 5X-2 | 5X-3 |
|---|---|---|---|---|---|
| Base Alloy Composition (Al + 5.0% Mg + 0.25% Sc + 0.11% Zr) Plus | — | 0.5% Mn | 1.0% Zn | 1.0% Cu | 1.0% Zn + 0.6% Mn |
| UTS (Ultimate Tensile Strength), ksi | 56.5 | 59.8 | 58.6 | 59.7 | 63.0 |
| YS (Yield Strength), ksi | 42.0 | 46.6 | 46.5 | 48.1 | 51.1 |
| EL (Elongation), % | 11.7 | 11.6 | 12.0 | 11.4 | 9.9 |

The test results for the 5X-1 and 5X-2 sample alloys indicate that substantial improvements in UTS and YS are obtained when 1.0% zinc or copper is added to the base Al—Mg—Sc—Zr alloy. In particular, for the zinc containing 5X-1 sample, the UTS and YS increased approximately 4% and 7%, respectfully. The increases in UTS and YS for the copper containing alloy, 5X-2, were even better at approximately 6% and 15%, respectively.

The third sample alloy, 5X-3, in which 1.0% zinc was added to an Al—Mg—Sc alloy containing both zirconium and manganese, had still better tensile properties, especially as compared to the basic zirconium containing Al—Mg—Sc alloy. When compared to the Al—Mg—Sc—Zr—Mn alloy, the improvements in UTS and YS were approximately 5 and 10%, respectfully. Even more significant were the improvements in UTS and YS when compared to the base Al—Mg—Sc—Zr alloy which were 11% and 22%, respectively.

From the test results, it is believed that even greater improvements in tensile properties may be realized if both zinc and copper are added to the alloys in the preferred ranges of approximately 0.5–2.0% each.

In addition to the tensile property measurements described above, the 0.125" sheets were subjected to TIG (tungsten inert gas) welding tests using Al-4.8% Mg 5183 alloy filler wire. Tensile specimens were then machined from the sheets with the weld region centered transversely in the reduced section. The tensile data from these tests are listed in Table 2.

TABLE 2

TENSILE PROPERTIES OF TIG-WELDED Al—Mg—Sc ALLOYS
(No Homogenization, 0.125", 550 F/8 hr anneal)

| Alloy | Al—Mg—Sc—Zr | Al—Mg—Sc—Zr—Mn | 5X-1 | 5X-2 | 5X-3 |
|---|---|---|---|---|---|
| Base Alloy Composition (Al + 5.0% Mg + 0.25% Sc + 0.11% Zr) Plus | — | 0.5% Mn | 1.0% Zn | 1.0% Cu | 1.0% Zn + 0.6% Mn |
| UTS (Ultimate Tensile Strength), ksi | 45.5 | 43.1 | 47.7 | 52.8 | 54.7 |
| YS (Yield Strength), ksi | 25.9 | 25.3 | 30.3 | 33.2 | 34.8 |
| EL (Elongation), % | 7.9 | 8.1 | 4.3 | 5.5 | 5.3 |

The data show significantly higher strengths in the Zn/Cu modified alloys, with or without a manganese addition.

EXAMPLES 4–6

As discussed previously, it has also discovered that hafnium may be employed instead of or with zirconium to stabilize the $Al_3Sc$ dispersoids. Thus, in each of the samples set forth in Table 1, hafnium can be substituted for zirconium or added in approximately the same amount, and it is believed that similar relative results will be obtained. Thus, the addition of zinc and/or copper to Al—Mg—Sc—Hf—Mn alloys should substantially improve the tensile properties of these alloys as well.

The values achieved for the tensile properties of the alloys of Examples 1–6 indicate that the alloys can readily be employed in rolled sheet form for various aerospace applications, such as for aircraft fuselage skins, etc. As stated previously, these applications for the subject alloys are particularly attractive because of the superior corrosion resistance and weldability of Al—Mg—Sc alloys.

Although the present invention has been disclosed in terms of a number of preferred embodiments, it will be understood that modifications and variations could be made thereto without departing from the scope of the invention as defined in the following claims.

What is claimed is:

1. An aluminum alloy consisting essentially of, in wt. %, 4.0–8.0% Mg, 0.05–0.6% Sc, 0.1–0.8% Mn, 0.5–2.0% Cu or Zn, 0.05–0.20% Hf or Zr, and the balance aluminum and incidental impurities.

2. The aluminum alloy of claim 1, wherein said alloy comprising both 0.5–2.0% Cu and 0.5–2.0% Zn.

3. The aluminum alloy of claim 2, wherein said alloy comprises both 0.05–0.20% Hf and 0.05–0.20% Zr.

4. The aluminum alloy of claim 1, wherein said alloy comprises both 0.05–0.20% Hf and 0.05–0.20% Zr.

5. The aluminum alloy of claim 1, wherein said alloy comprises 4.0–6.0% Mg, 0.2–0.4% Sc, 0.3–0.7% Mn, 0.08–0.15% Hf or Zr, 0.6–1.5% Cu or Zn, and the balance aluminum and incidental impurities.

6. The aluminum alloy of claim 5, wherein said alloy consists essentially of both 0.6–1.5% Cu and 0.6–1.5% Zn.

7. The aluminum alloy of claim 6, wherein said alloy comprises both 0.08–0.15% Hf and 0.08–0.15% Zr.

8. The aluminum alloy of claim 5, wherein said alloy consists essentially of both 0.08–0.15% Hf and 0.08–0.15% Zr.

9. The aluminum alloy of claim 5, wherein said alloy consists essentially of 5.0% Mg, 0.25% Sc, 0.6% Mn, 0.12% Hf or Zr, 1.0% Cu or Zn, and the balance aluminum and incidental impurities.

10. The aluminum alloy of claim 9, wherein said alloy consists essentially of both 1.0% Cu and 1.0% Zn.

11. The aluminum alloy of claim 10, wherein said alloy comprises both 0.12% Hf and 0.12% Zr.

12. The aluminum alloy of claim 9, wherein said alloy consists essentially of both 0.12% Hf and 0.12% Zr.

13. An aluminum alloy consisting essentially of, in wt. %, 4.0–8.0% Mg, 0.05–0.6% Sc, 0.5–2.0% Cu or Zn, 0.05–0.20% Hf or Zr, and the balance aluminum and incidental impurities.

14. The aluminum alloy of claim 13, wherein said alloy comprises both 0.5–2.0% Cu and 0.5–2.0% Zn.

15. The aluminum alloy of claim 14, wherein said alloy consists essentially of both 0.05–0.20% Hf and 0.05–0.20% Zr.

16. The aluminum alloy of claim 13, wherein said alloy consists essentially of both 0.05–0.20% Hf and 0.05–0.20% Zr.

17. The aluminum alloy of claim 13, wherein said alloy consists essentially of 4.0–6.0% Mg, 0.2–0.4% Sc, 0.08–0.15% Hf or Zr, 0.6–1.5% Cu or Zn, and the balance aluminum and incidental impurities.

18. The aluminum alloy of claim 17, wherein said alloy consists essentially of both 0.6–1.5% Cu and 0.6–1.5% Zn.

19. The aluminum alloy of claim 18, wherein said alloy consists essentially of both 0.08–0.15% Hf and 0.08–0.15% Zr.

20. The aluminum alloy of claim 17, wherein said alloy consists essentially of both 0.08–0.15% Hf and 0.08–0.15% Zr.

21. The aluminum alloy of claim 17, wherein said alloy consists essentially of 5.0% Mg, 0.25% Sc, 0.12% Hf or Zr, 1.0% Cu or Zn, and the balance aluminum and incidental impurities.

22. The aluminum alloy of claim 21, wherein said alloy consists essentially of both 1.0% Cu and 1.0% Zn.

23. The aluminum alloy of claim 22, wherein said alloy consists essentially of both 0. 12% Hf and 0.12%Zr.

24. The aluminum alloy of claim 21, wherein said alloy consists essentially of both 0. 12% Hf and 0. 12% Zr.

25. A rolled alloy sheet product comprised of an aluminum alloy, said alloy consisting essentially of, in wt. %, 4.0–8.0% Mg, 0.05–0.6% Sc, 0.1–0.8% Mn, 0.5–2.0% Cu or Zn, 0.05–0.20% Hf or Zr, and the balance aluminum and incidental impurities.

26. The rolled alloy sheet product of claim 25, wherein said alloy consists essentially of both 0.5–2.0% Cu and 0.5–2.0% Zn.

27. The rolled alloy sheet product of claim 26, wherein said alloy consists essentially of both 0.05–0.20% Hf and 0.05–0.20% Zr.

28. The rolled alloy sheet product of claim 25, wherein said alloy consists essentially of both 0.05–0.20% Hf and 0.05–0.20% Zr.

29. The rolled alloy sheet product of claim 25, wherein said alloy consists essentially of 4.0–6.0% Mg, 0.2–0.4% Sc, 0.3–0.7% Mn, 0.08–0.15% Hf or Zr, 0.6–1.5% Cu or Zn, and the balance aluminum and incidental impurities.

30. The rolled alloy sheet product of claim 29, wherein said alloy consists essentially of both 0.6–1.5% Cu and 0.6–1.5% Zn.

31. The rolled alloy sheet product of claim 30, wherein said alloy consists essentially of both 0.08–0.15% Hf and 0.08–0.15% Zr.

32. The rolled alloy sheet product of claim 19, wherein said alloy consists essentially of both 0.08–0.15% Hf and 0.08–0.15% Zr.

33. The rolled alloy sheet product of claim 29, wherein said alloy consists essentially of 5.0% Mg, 0.25% Sc, 0.6% Mn, 0.12% Hf or Zr, 1.0% Cu or Zn, and the balance aluminum and incidental impurities.

34. The rolled alloy sheet product of claim 33, wherein said alloy consists essentially of both 1.0% Cu and 1.0% Zn.

35. The rolled alloy sheet product of claim 34, wherein said alloy consists essentially of both 0.12% Hf and 0.12% Zr.

36. The rolled alloy sheet product of claim 33, wherein said alloy consists essentially of both 0. 12% Hf and 0.12% Zr.

37. A rolled alloy sheet product comprised of an aluminum alloy, said alloy consisting essentially of, in wt. %, 4.0–8.0% Mg, 0.05–0.6% Sc, 0.5–2.0% Cu or Zn, 0.05–0.20% Hf or Zr, and the balance aluminum and incidental impurities.

38. The rolled alloy sheet product of claim 37, wherein said alloy consists essentially of both 0.5–2.0% Cu and 0.5–2.0% Zn.

39. The rolled alloy sheet product of claim 38, wherein said alloy consists essentially of both 0.05–0.20% Hf and 0.05–0.20% Zr.

40. The rolled alloy sheet product of claim 37, wherein said alloy consists essentially of both 0.05–0.20% Hf and 0.05–0.20% Zr.

41. The rolled alloy sheet product of claim 37, wherein said alloy consists essentially of 4.0–6.0% Mg, 0.2–0.4% Sc, 0.08–0.15% Hf or Zr, 0.6–1.5% Cu or Zn, and the balance aluminum and incidental impurities.

42. The rolled alloy sheet product of claim 41, wherein said alloy consists essentially of both 0.6–1.5% Cu and 0.6–1.5% Zn.

43. The rolled alloy sheet product of claim 42, wherein said alloy consists essentially of both 0.08–0.15% Hf and 0.08–0.15% Zr.

44. The rolled alloy sheet product of claim 41, wherein said alloy consists essentially of both 0.08–0.15% Hf and 0.08–0.15% Zr.

45. The rolled alloy sheet product of claim 41, wherein said alloy consists essentially of 5.0% Mg, 0.25% Sc, 0.12% Hf or Zn, 1.0% Cu or Zn, and the balance aluminum and incidental impurities.

46. The rolled alloy sheet product of claim 45, wherein said alloy comprises both 1.0% Cu and 1.0%Zn.

47. The rolled alloy sheet product of claim 46, wherein said alloy consists essentially of both 0.12% Hf and 0.12% Zr.

48. The rolled alloy sheet product of claim 45, wherein said alloy consists essentially of both 0.12% Hf and 0.12%Zr.

* * * * *